United States Patent [19]

Wilkinson

[11] Patent Number: 4,643,307

[45] Date of Patent: Feb. 17, 1987

[54] PACKING ARRANGEMENT FOR ARTICLES OF DIFFERENT SIZE

[76] Inventor: Don Wilkinson, 32 S. Palm Ave., Sarasota, Fla. 33577

[21] Appl. No.: 827,071

[22] Filed: Feb. 7, 1986

[51] Int. Cl.[4] ..... B65D 85/20; B65D 85/62; B65B 59/00

[52] U.S. Cl. ..... 206/443; 206/446; 206/500; 206/526; 206/585; 53/474; 53/399

[58] Field of Search ..... 206/443, 446, 430, 379, 206/500, 526, 584, 499, 585; 53/474, 399, 403; 220/4 E

[56] References Cited

U.S. PATENT DOCUMENTS

| | | | |
|---|---|---|---|
| 585,879 | 7/1897 | Uptegraff | 206/500 |
| 1,713,301 | 5/1929 | Rosskam | 206/584 |
| 2,062,948 | 12/1936 | Swank et al. | 105/369 |
| 2,112,486 | 3/1938 | Francis et al. | 206/499 |
| 2,351,815 | 6/1944 | Jensen | 206/379 |
| 2,409,750 | 10/1946 | Frear | 206/499 |
| 3,216,585 | 11/1965 | Whittle | 211/60.1 |
| 3,229,814 | 1/1966 | Cowman | 206/585 |
| 3,262,859 | 7/1966 | Winsche | 206/499 |
| 3,596,781 | 2/1969 | Burton | 206/443 |
| 3,682,597 | 8/1972 | Husch | 206/446 |
| 3,945,568 | 3/1976 | Bychowski | 220/4 E |
| 4,235,065 | 11/1980 | Freeman | 53/472 |
| 4,333,571 | 6/1982 | Martelli | 206/499 |
| 4,432,689 | 2/1984 | Shell | 108/52.1 |
| 4,503,978 | 3/1985 | Smit et al. | 211/60.1 |

FOREIGN PATENT DOCUMENTS

| | | | |
|---|---|---|---|
| 2156018 | 5/1973 | Fed. Rep. of Germany | 206/589 |

*Primary Examiner*—William Price
*Assistant Examiner*—Brenda J. Ehrhardt
*Attorney, Agent, or Firm*—Charles J. Prescott; Raymond H. Quist

[57] ABSTRACT

A packing arrangement for bodies having circular cross-sections of unequal radii is disclosed. The radii of the bodies are proportional to one, two and three. Each body of one radius is adjacent to at least one body of each of the other radii. These bodies either are tangent to each other or at least two lines joining the centers of adjacent bodies will be at right angles to each other. The bodies may be cylindrical or spherical.

12 Claims, 7 Drawing Figures

Fig. 1
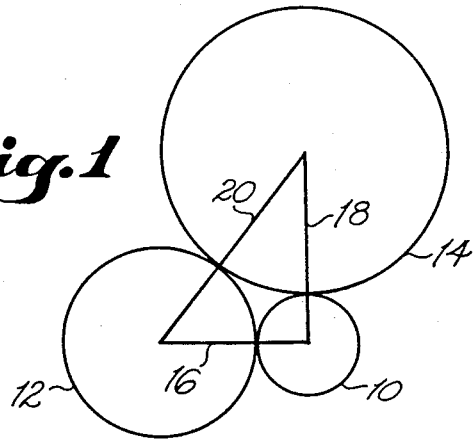
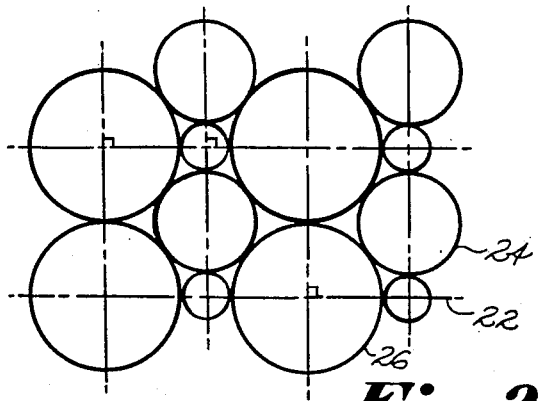
Fig. 2
Fig. 3
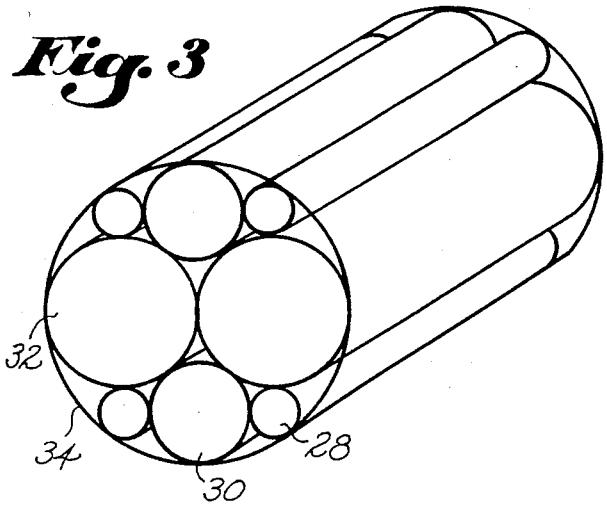
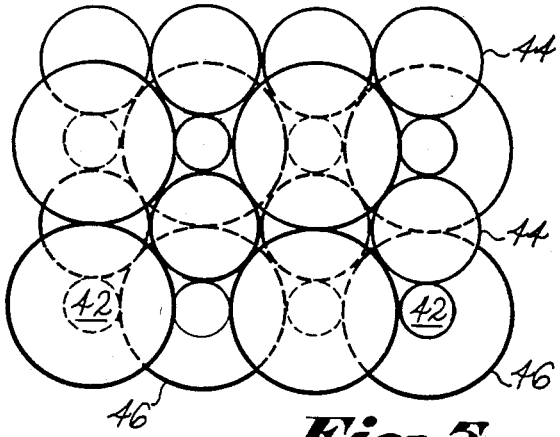
Fig. 5
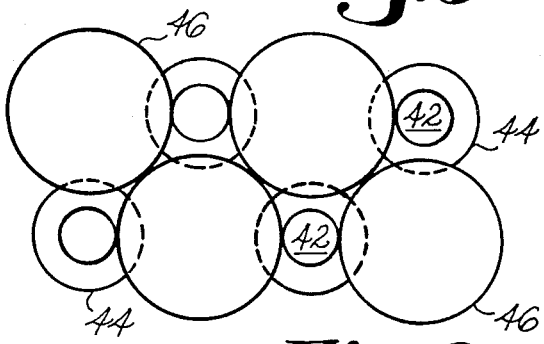
Fig. 6
Fig. 4
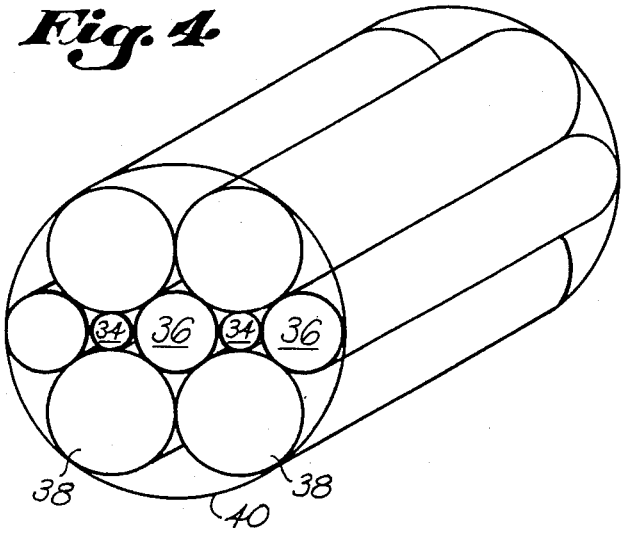
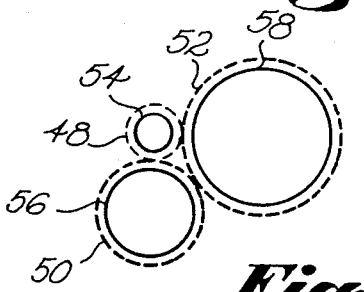
Fig. 7

PACKING ARRANGEMENT FOR ARTICLES OF DIFFERENT SIZE

BACKGROUND OF THE INVENTION

1. Field of the Invention

This invention relates generally to a packing arrangement for bodies having circular cross-sections, and more particularly to a close packing arrangement for bodies having circular cross-sections of three different radii.

2. Description of Related Art

Packing of bodies having equal circular cross-sections, such as cans of food, is normally performed in an egg crate type manner so that the centers of four adjacent circles are located at the vertices of a square to give an overall rectangular configuration. It is also well known to offset one tier or row of these circular cross-sectioned bodies from the next so that the centers of four adjacent circles are located at the vertices of a parallelepiped to give a more dense or close packing.

Close packing of spheres of equal size is performed one way in a cubic close packing where twelve spheres are arranged to form a cube having three tiers of four spheres, with the center tier offset from the top and bottom tiers. In infinite aggregations of a cubic close packing arrangement each sphere contacts twelve other spheres. In addition to the cubic close packing, a hexagonal close packing arrangement of equal sized spheres is known. Robert Williams in a book entitled "The Geometrical Foundation of Natural Structure, A Source Book of Design", Dover Publications, Inc., 1979, provides descriptions of these arrangements.

In "Solid Geometry", L. Lines, Dover Books, 1965, in Chapter 14—Sphere Packs, the definition is given: "If an infinite number of equal spheres are arranged so that every sphere is similarly related to the rest and in contact with at least four of them, they are said to form a sphere pack."

All of the foregoing arrangements relate to bodies having equal circular cross-sections. No similar descriptions relating to packing arrangements of bodies having unequal circular cross-sections have been located.

The present invention involves packing arrangements for bodies having three different circular cross-sections, which provide a close packing.

It is therefore an object of this invention to provide a packing arrangement for bodies having circular cross-sections, and radii in the ratio of one, two and three.

It is a further object of this invention to provide a packing arrangement for bodies which, while not having circular cross-sections precisely, approximate circular cross-sections, and have radii for such approximate cross-sections in the ratio of one, two and three.

It is also an object of this invention to define certain particularly useful packing arrangements of bodies having circular cross-sections or approximations thereof and radii in the ratio of one, two and three.

It is a further object of this invention to provide a basic sphere packing arrangement using spheres having radii in the ratio of one, two and three.

It is a still further object to provide such a sphere packing arrangement which can be expanded with successive layers to form a sphere pack.

In accordance with these and other objects, which will become apparent hereafter, the instant invention will now be described with reference to the accompanying drawings.

BRIEF DESCRIPTION OF THE DRAWINGS

FIG. 1 is a schematic illustrating relationships of the circular cross-sections of this invention;

FIG. 2 is a schematic showing the circular cross-sections of FIG. 1 in a packing arrangement;

FIG. 3 represents a packing arrangement of cylinders having circular cross-sections of three different radii;

FIG. 4 represents another packing arrangement of cylinders having circular cross-sections of three different radii;

FIG. 5 is a plan view of two layers of spheres having three different radii in a closs packing arrangement;

FIG. 6 is an elevation of the two layers of FIG. 5; and

FIG. 7 is an alternate version of FIG. 1.

SUMMARY OF THE INVENTION

The invention relates to the packing of bodies having three different circular cross-sections, the radii of which are in the ratio of one, two and three. These bodies may be cylinders or spheres. In some cases the radii describe the locus of points on the perimeters of the bodies. The term packing relates to the way the bodies are grouped, which can be described as orthogonally.

DETAILED DESCRIPTION OF THE INVENTION

Referring to FIG. 1, circles 10, 12 and 14 are shown arranged to be tangent to each other. Circles 10, 12 and 14 have radii which are in the ratio of one, two and three. That is, if circle 10 has a radius of 4, then circle 12 will have a radius of 8 and circle 14 will have a radius of 12. Obviously, their diameters are also in the ratio of one, two and three.

The centers of circles 10, 12 and 14 have been connected to each other by straight lines 16, 18 and 20. It will be observed that the triangle formed by lines 16, 18 and 20 is a right triangle, and, if one assumes that circles 10, 12 and 14 have radii of 1, 2 and 3 respectively, then lines 16, 18 and 20 will have lengths of 3, 4 and 5 respectively. These relationships are those on which this invention is based.

It will be shown now that this ratio of relative lengths, which packs, is the only one which will do so in this manner.

If the radii of circles 10, 12 and 14 are x, y and z, respectively. And, if lines 16, 18 and 20 are designated as a, b and c, respectively.

Then:

$$a=x+y$$

$$b=x+z$$

$$c=y+z$$

So:

$$a - \begin{array}{l} a = x + y \\ \underline{b = x + z} \\ b = y - z \end{array} \quad \begin{array}{l} c = y + z \\ z = c - y \end{array}$$

$$y = a - b + z$$

$$y = a - b + c - y$$

$$y = \frac{a - b + c}{2}$$

-continued $$z = c - y$$

$$2z = 2c - a + b - c$$

$$z = \frac{-a + b + c}{2}$$

$$x = a - y$$

$$2x = 2a - a + b - c$$

$$x = \frac{a + b - c}{2}$$

It will be observed from the drawing that x+y=z=a. So:

$$a = \frac{-a + b + c}{2}$$

$$2a = -a + b + c$$

$$3a + b + c$$

Which can be written:

$$9a^2=b^2+2bc+c^2$$

ps Since the triangle is a right triangle, we can say:

$$a^2+b^2=c^2 \text{ or } a^2=c^2-b^2$$

Then:

$$9c^2-9b^2=b^2+2bc+c^2$$

$$4c^2-5b^2-bc=0$$

$$(4c-5b)(c+b)=0$$

$$4c=5b$$

$$b=(4/5)c$$

then $$3a=(4/5)c+c$$

and $$a=(3/5)c$$

$$\frac{a}{3} = \frac{b}{4} = \frac{c}{5}$$

Referring now to FIG. 2, the basic relationship discussed with respect to FIG. 1 is carried forward into a packing arrangement. Small circles 22, medium circles 24 and large circles 26 are arranged in the same relationship as shown in FIG. 1, but in FIG. 2 it is apparent that the relationship can be expanded both vertically and horizontally, ad infinitum. It will also be observed that the lines through the centers of the circles are orthogonally related. If these circles are considered cylindrical objects such as cans of different sizes, it is evident that they can be closely packed within a rectangular packing case, the dimensions of which can be sized to hold any desired number of cylinders of the three sizes. If these circles are considered to be a cross-section through a group of wires, it is also evident that the number of such wires may be expanded as desired and wound into a cable.

Referring to FIG. 3, an array of cylindrical objects is shown which illustrates one way of utilizing the packing arrangement of this invention. Small cylinders 28, medium cylinders 30 and large cylinders 32 together form a compact array which may be contained within a cylindrical envelope 34. The radii of cylinders 28–32 are related by the ratio of one, two and three; and it will be observed that the arrangement is a portion of that shown in FIG. 2. Cylindrical envelope 34 is shown in FIG. 3 merely as an outline, because it need not be a part of the array. On the other hand, cylindrical envelope 34 could be constituted as a shell or container for cylinders 28–32. It should also be recogized that cylinders 28–32 could themselves be cylindrical envelopes, serving as containers of cylindrical arrays.

It will be apparent that cylinders 28–32 could be containers for gases or liquids. In addition, cylinders 28–32 can be extended longitudinally to form pipes capable of carrying eight different fluids simultaneously. These limited examples of applications will be supplemented subsequently.

Referring next to FIG. 4, another array of cylindrical objects or bodies is shown which utilizes the packing arrangement of this invention. Small cylinders 34, medium cylinders 36 and large cylinders 38 together form a compact array which may be contained within a cylindrical envelope 40. Cylindrical envelope 40 is shown in FIG. 4 merely as an outline, because it need not be a part of the array as was mentioned with respect to FIG. 3. The radii of cylinders 34–38 are proportional to one, two and three, respectively. The array of FIG. 4 will be seen to be a portion of the array shown in FIG. 2, with the addition of one more medium sized circle in the appropriate position.

FIGS. 5 and 6 which are, respectively, plan and elevation views of a spherical close packing arrangement will now be considered. Small spheres 42, medium spheres 44 and large spheres 46 are arranged in two layers, with the top layer offset from the bottom layer, as shown. The radii of spheres 42–46 are proportional to one, two and three. It should be recognized that additional layers can be stacked above and below the two layers shown, and that all layers can be extended or reduced as desired using more or less similar spheres. Small spheres 42 while tangent on all four sides in the plan view, will be observed, in the elevation, to have limited vertical movement. As shown in FIGS. 5 and 6, however, orthogonal relationships exist—not only within each layer—but also, between layers. This characteristic together with the tangencies between adjacent spheres results in the packing arrangement. It should be recognized that the same relationships first described in FIG. 1, still exist in this sphere pack.

FIG. 7 displays another aspect of the invention. Small circle 48, medium circle 50 and large circle 52, all shown in broken lines, are related in the same manner as circles 10–14 of FIG. 1. Each of the circles 48–52 contains a smaller circle 54–58, respectively. Circles 54–58 have identical centers to those of circles 48–52. Circles 54–58 represent a packing arrangement wherein space is provided between the bodies for walls, insulation, spacers, etc. Each of FIGS. 2–6 may be considered similarly modified to provide such spacing.

This invention pertains to packing in the mathematical sense because the simple patterns can be expanded without limit while still maintaining the same relationships between adjacent spheres or cylinders. This mathematical aspect of the invention could be employed in new molecular and crystal structures. This invention also relates to packing in the conventional sense of placing objects in containers for packaging, storage, shipment, etc. Some examples of this conventional packing will now be given. Spherical and cylindrical containers for fluids. Cables formed by winding wires of different diameters. Clustering of differently sized jet engine combustion chambers may be performed to achieve an increase in thrust. Clustering of pipes within boilers. Clustering of barrels for firearms. Clustering of multiple, independently maneuverable reentry vehicles of different capabilities. Clustering of different sized lenses and shutters.

While the invention has been shown and described herein in what are conceived to be the most practical and preferred embodiments, it is recognized that departures may be made therefrom within the scope of the invention. The scope is therefore not to be limited to the details disclosed herein but is to be accorded the full scope of the claims so as to embrace any and all equivalent apparatus and articles.

I claim:

1. A packing arrangement comprising:

a plurality of bodies having circular cross-sections;

said circular cross-sections having radii proportional to one, two and three; and each of said bodies having one of said radii being tangent to at least two of said bodies having the other two radii.

2. A packing arrangement in accordance with claim 1 wherein:

said bodies are cylindrical.

3. A packing arrangement in accordance with claim 1 wherein: said bodies are spherical.

4. A packing arrangement in accordance with claim 2 wherein:

said bodies are contained in a cylindrical envelope.

5. A packing arrangement in accordance with claim 4 wherein:

said bodies are pipes.

6. A packing arrangement in accordance with claim 4 wherein:

said bodies are containers.

7. A packing arrangement in accordance with claim 4 wherein:

said cylindrical bodies include four having radii proportional to one, two having radii proportional to two and two having radii proportional to three.

8. A packing arrangement in accordance with claim 4 wherein:

said cylindrical bodies include two having radii proportional to one, three having radii proportional to two and four having radii proportional to three.

9. A packing arrangement in accordance with claim 4 wherein:

said cylindrical bodies are wires in a cable.

10. A packing arrangement comprising:

a plurality of bodies having circular cross-sections;

said circular cross-sections having radii proportional to one, two and three; and said bodies so arranged that at least two lines passing through the center points of adjacent bodies will be at right angles to each other.

11. A packing arrangement in accordance with claim 10 wherein:

each of said bodies includes an outer circular layer.

12. A packing arrangement in accordance with claim 10 wherein:

at least three lines passing through the center points of adjacent bodies will be at right angles to each other.

* * * * *